United States Patent [19]

Jenkner

[11] Patent Number: 4,612,966

[45] Date of Patent: Sep. 23, 1986

[54] PROCESS FOR THE PARALLEL SPLITTING UP OF TRIMMED WORKPIECE PANELS, IN PARTICULAR, OF LAMINATED, COMPRESSED WOOD PANELS

[76] Inventor: Detlef Jenkner, Schwarzwaldstr. 68, Herrenberg, Fed. Rep. of Germany, D-7033

[21] Appl. No.: 719,489

[22] Filed: Apr. 3, 1985

[30] Foreign Application Priority Data

Jul. 9, 1984 [DE] Fed. Rep. of Germany ..... 3425204

[51] Int. Cl.[4] ..... B27L 7/00

[52] U.S. Cl. ..... 144/366; 83/36; 83/435.1; 83/707; 83/713; 144/359; 144/376

[58] Field of Search ..... 144/359, 366, 376; 83/36, 707, 713

[56] References Cited

U.S. PATENT DOCUMENTS 4,155,283 5/1979 Mericle ..... 83/435.1

FOREIGN PATENT DOCUMENTS 638002 5/1950 United Kingdom .

*Primary Examiner*—W. D. Bray

*Attorney, Agent, or Firm*—Dick and Harris

[57] ABSTRACT

During the parallel splitting up of workpiece panels, in particular, consisting of laminated, compressed wood, it is usually not possible to prevent one of the two panel sections resulting after completion of the last separating cut, more particularly, that which was clamped in the feeding device, from warping on account of material tensions, thereby rendering it useless. In order to avoid this, it is proposed that the trimmed edge of the last remaining panel section facing away from the cutting plane be released prior to the final feeding procedure to be carried out, that it be clamped again immediately thereafter, that a further trimming cut be made on the panel section, and that this panel section then be fixed following the final feeding procedure and trimmed anew. In this process, the last resulting panel section is relieved of tension before being finally trimmed along its two longitudinal sides. This ensures that the trimmed edges subsequently produced thereon are exactly parallel to one another.

1 Claim, 3 Drawing Figures

PROCESS FOR THE PARALLEL SPLITTING UP OF TRIMMED WORKPIECE PANELS, IN PARTICULAR, OF LAMINATED, COMPRESSED WOOD PANELS

The invention relates to a process for the parallel splitting up of trimmed workpiece panels, in particular, of laminated, compressed wood panels, wherein single workpiece panels with a trimmed edge facing away from a cutting plane are aligned parallel to the cutting plane and clamped along the plane of alignment, whereupon in order to divide off single panel sections, with this trimmed edge, the workpieces are displaced along a path corresponding to the desired sectional width in the direction of and parallel to the cutting plane, subsequently clamped in the area of the latter, and then severed.

Use of the process explained hereinabove for splitting up workpiece panels is already known.

On account of material tensions present in workpiece panels, in particular, in laminated, compressed wood panels, it is not possible to prevent one of the two panel sections resulting after completion of the last separating cut from being useless. This is the panel section which, after completion of the last separating cut, is clamped on one of its sides along the plane of alignment.

The trimmed edge of this panel section produced by the last separating cut does extend parallel to its trimmed edge fixed in the plane of alignment, however, once the panel section is released, it warps in its bearing plane in such a manner that the last produced trimmed edge assumes a slightly convex and the opposite trimmed edge a correspondingly concave shape.

The object underlying the invention is therefore to indicate a process for the parallel splitting up of trimmed workpiece panels, in particular, of laminated, compressed wood panels, with which the last panel section produced in the splitting up procedure acquires trimmed edges which are parallel to one another in spite of unavoidable material tensions.

This object is attained in accordance with the invention in that the trimmed edge of the last remaining panel section facing way from the cutting plane is released prior to the final feeding procedure to be carried out, and clamped again immediately thereafter, and a further trimming cut is made on the panel section, and in that the panel section is then fixed following the final feeding procedure and trimmed anew.

With this process, a total of three trimmed edges are therefore produced on the remaining panel section, the first of which is made while the panel section is in the clamped state.

The panel section is then released to enable deformation under the influence of its material tensions and assumption of a tension-free state.

During this deformation, the panel section remains, with its longitudinal edge assuming a concave configuration, supported in its end areas in the plane of alignment, with the result that the last produced trimmed edge at the same time also moves beyond the cutting plane once it assumes a slightly bulging shape. With its edge ends, however, it remains substantially within the cutting plane.

Accordingly, when the relaxed panel section is then clamped again, and a separating cut is made anew, there is severed from the panel section a segment-shaped marginal strip protruding beyond the cutting plane, whereby a new trimmed edge which retains its straight configuration is created.

When this trimmed edge has been produced, and a last feeding motion has been carried out, a further separating cut is made and thus the third trimmed edge is produced on this panel section, with the concave edge portion being severed therefrom.

The process therefore enables all of the panel sections produced by the splitting up of workpiece panels to be of parallel-edged configuration, resulting in the elimination of rejects.

Viewed perpendicularly to the cutting plane and parallel to the bearing plane, the dimension of workpiece panels to be split up is to be chosen sufficiently larger for the panel section to have the desired width after the segment-shaped and the concave marginal strips have been severed.

It is, however, of course, also possible to process workpiece panels which do not have such dimensions. In this case, the width of the remaining panel section is correspondingly less, and if series of panel sections of different widths are produced, the feeding for the production of the last trimmed edge on the remaining panel section is chosen such that the latter will correspond width-wise with another series of panel sections.

The performance of the process is elucidated in the schematic illustrations.

Figure 1:
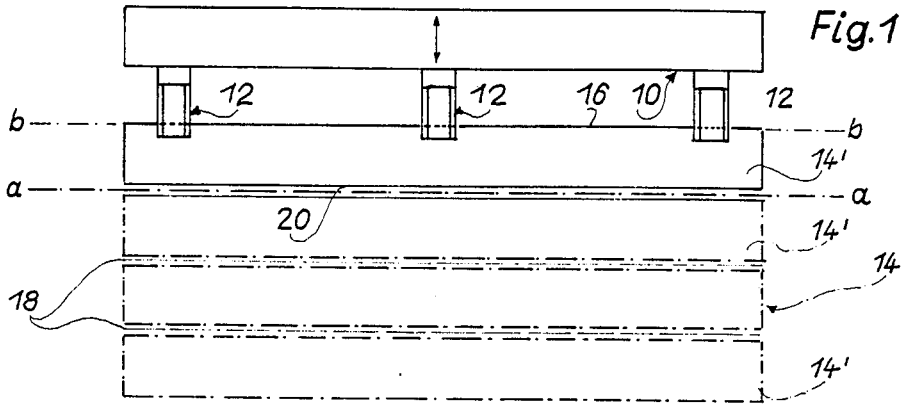
FIG. 1 is a top view of a feeding device of a workpiece panel splitting up system which is step-wise adjustable transversely to the cutting plane a—a of the latter, in a position relative to the cutting plane involving the last two panel sections of a workpiece panel to be split up.
Figure 2:
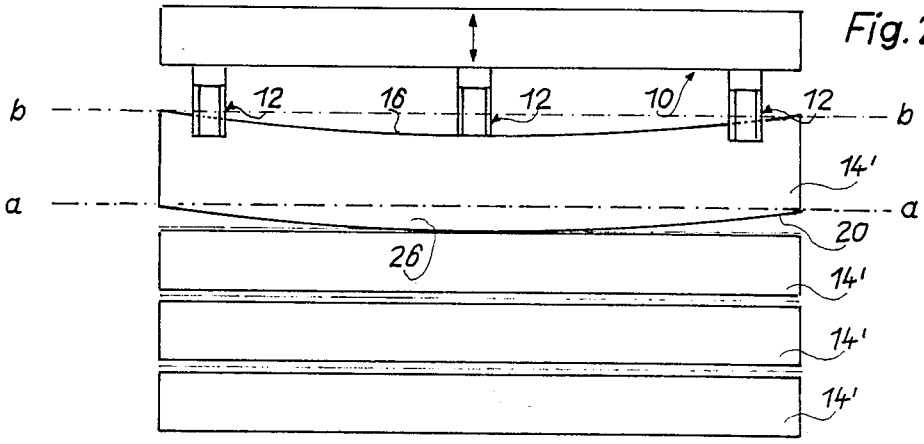
FIG. 2 is an illustration similar to FIG. 1, wherein the panel section fixed on the feeding device has been briefly released from it and clamped again immediately thereafter.
Figure 3:
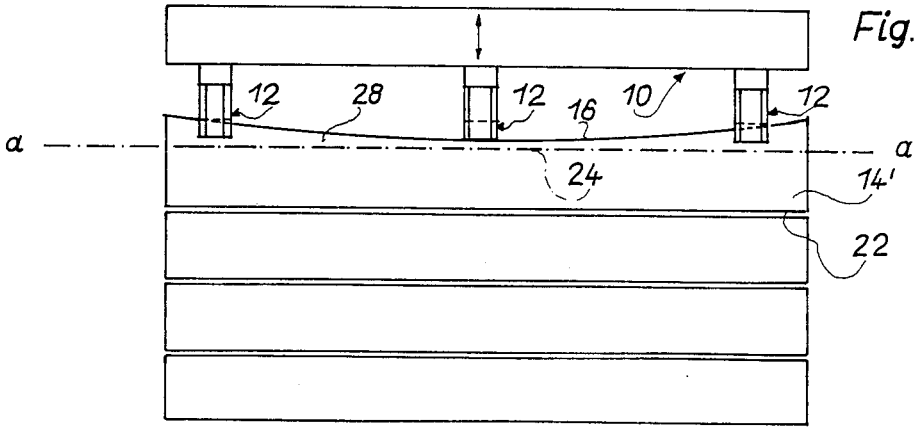
FIG. 3 is an illustration similar to FIG. 2, wherein the feeding device for performance of the last separating cut has been correspondingly adjusted in the direction of the cutting plane a—a.

In FIGS. 1 to 3, a feeding device of a workpiece panel splitting up system is designated in its entirety by 10. It comprises on its longitudinal side facing the cutting plane a—a of the workpiece panel splitting up system, for example, three workpiece panel clamping devices, designated in their entirety by 12, which define a plane of alignment b—b parallel to the cutting plane a—a. Designated by 14, in its entirety, is a workpiece panel consisting, for example, of compressed wood which is laminated on both sides with a plastics material and is to be split up, for example, into four panel sections 14' of equal width, parallel to the plane of alignment b—b.

The workpiece panel 14 is first placed onto the work table of the workpiece panel splitting up system and clamped with its marginal section comprising the trimmed edge 16 in the workpiece panel clamping devices 12, with the trimmed edge 16 being fixed in the plane of alignment b—b.

The workpiece panel 14 is then adjusted with the aid of the feeding device 10 for each separating cut to be made in the direction of the cutting plane a—a along predetermined paths corresponding to the desired width of the panel sections to be produced and is fixed. To produce the panel sections 14' a separating cut 18 is then respectively made along the cutting plane a—a.

FIG. 1 shows the situation in which the workpiece panel 14 is split up into a total of four single panel sections 14'.

Of these four panel sections, the first three panel sections produced retain their parallel-edged configuration.

The fourth panel section fixed in the feeding device 10, however, changes its shape on account of the presence of material tensions as soon as it is released from the workpiece panel clamping devices 12. This change in shape is apparent from FIG. 2. This panel section 14' warps in its bearing plane in such a manner that its last produced trimmed edge 20 becomes slightly convex and its other longitudinal edge constituting the original trimmed edge 16 of the workpiece 14 bulges accordingly. With such a hitherto used conventional technique of splitting up panels, this panel section therefore had to be discarded.

Such rejects may, however, be eliminated if the following measures are taken:

When the workpiece panel 14 has been split up into, for example, four panel sections, the panel section 14' clamped in the workpiece panel clamping devices 12 is released to enable stress:relief and assumption of the shape shown in FIG. 2, whereupon this panel section is clamped again. FIG. 2 shows that the longitudinal edge 16 of this panel section 14', during its banana-shaped warping, is further supported at the two outer workpiece panel clamping devices 12 in the plane of alignment b—b, with the result that its previously produced trimmed edge 20 moves beyond the cutting plane a—a.

When this panel section 14' has been clamped again, a further separating cut is therefore made, and a second trimmed edge 22 is thus formed on this panel section 14' along the same longitudinal side. The feeding device is subsequently driven from the last time along a feed path corresponding to the desired width of this panel section 14' in the direction of the cutting plane a—a, whereupon after clamping of the panel section, a final separating cut is made, and a third trimmed edge 24, indicated by a dot-and-dash line in FIG. 3, is thus formed on this panel section.

In the production of the front trimmed edge 22, the segment-shaped marginal strip 26 defined in FIG. 2 by the convex trimmed edge 20 and the cutting plane a—a, and also the edge portion 28 defined by the concave trimmed edge 16 and the cutting plane a—a were severed from this panel section 14', which on account of the relaxation of its material when the last two separating cuts are made, acquires the same dimensions and parallel-edged configuration as the other panel sections 14' produced.

In order to ensure that the last panel section 14' to be produced acquires the same width as the other panel sections 14', the dimensions of workpiece panels to be split up, viewed perpendicularly to the cutting plane and parallel to the bearing plane, are to be chosen sufficiently larger for the panel section 14' to have the desired width after severing of the marginal strips 26 and 28.

In this connection, it should be noted that the extent of the above-explained warping of the last panel section occurring is normally only a few millimeters. This warping has been deliberately exaggerated in the drawings in order to simplify comprehension of the process according to the invention.

What is claimed is:

1. A process for the parallel splitting up of trimmed workpiece panels and, in particular, laminated, compressed wood panels by a cutter defining a cutting plane, into cut sections of predetermined sectional widths, all of which having substantially parallel trimmed edges, which comprises the steps of:

aligning a single workpiece panel, with a trimmed edge facing away from a cutting plane, parallel to said cutting plane;

clamping of said workpiece panel along a plane of alignment with respect to said cutting plane;

displacing said panel along a path corresponding to said desired sectional width of said cut section and in the direction of and substantially parallel to said cutting plane;

feeding of said panel into said cutter in order to sever and divide off one or more single cut panel sections, having substantially parallel trimmed edges;

releasing of said clamping of the remainder of said workpiece panel so as to permit said trimmed marginal edge portions thereof to warp;

reclamping of said warped workpiece panel;

displacing said warped workpiece panel along a path corresponding to said desired sectional width of said cut section and in the direction of and substantially parallel to said cutting plane;

feeding of said workpiece panel into said cutter, so as to sever and remove a first selected warped marginal edge portion thereof;

realigning of the remaining portion of said workpiece panel with respect to said cutting plane, so as to correspond to said desired sectional width of said cut section and align said remaining warped marginal edge portion with said cutting plane;

displacing said remaining workpiece panel in the direction of and substantially parallel to said cutting plane; and feeding of said panel into said cutting so as to sever and remove said remaining warped marginal edge portion of said panel and result in a cut section having said predetermined sectional width and substantially parallel trimmed edges.

* * * * *